US010055997B2

(12) United States Patent
Judy et al.

(10) Patent No.: US 10,055,997 B2
(45) Date of Patent: Aug. 21, 2018

(54) SYSTEMS AND METHODS FOR MANAGING NON-INTEGRATED CPDLC SYSTEMS FROM A FIRST CPDLC SYSTEM

(71) Applicant: Honeywell International Inc., Morristown, NJ (US)

(72) Inventors: Vicki Judy, Cave Creek, AZ (US); Thomas D. Judd, Woodinville, WA (US)

(73) Assignee: Honeywell International Inc., Morris Plains, NJ (US)

( * ) Notice: Subject to any disclaimer, the term of this patent is extended or adjusted under 35 U.S.C. 154(b) by 860 days.

(21) Appl. No.: 13/765,951

(22) Filed: Feb. 13, 2013

(65) Prior Publication Data

US 2014/0229093 A1 Aug. 14, 2014

(51) Int. Cl.
*G08G 5/00* (2006.01)

(52) U.S. Cl.
CPC ..... *G08G 5/0013* (2013.01)

(58) Field of Classification Search
None
See application file for complete search history.

(56) References Cited

U.S. PATENT DOCUMENTS 6,313,759 B1 11/2001 Musland-Sipper
6,353,779 B1 3/2002 Simon et al.
6,946,976 B1 9/2005 Langner et al.
7,495,602 B2 * 2/2009 Sandell et al. ..... 342/37
7,647,139 B2 1/2010 Sandell et al.
7,835,316 B2 11/2010 McGuffin et al.
7,860,642 B2 * 12/2010 Sandell et al. ..... 701/120
(Continued)

FOREIGN PATENT DOCUMENTS

CN 102710429 10/2012
EP 2109087 10/2009
(Continued)

OTHER PUBLICATIONS

United States Patent and Trademark Office, "Office Action for U.S. Appl. No. 12/888,499", dated Oct. 9, 2014, pp. 1-26, Published in: US.

(Continued)

*Primary Examiner* — Jerrah Edwards
*Assistant Examiner* — Kelly D Williams
(74) *Attorney, Agent, or Firm* — Fogg & Powers LLC

(57) ABSTRACT

In one embodiment, a method for implementing a non-integrated CPDLC solution is provided. The method includes monitoring a datalink router for messages from a first CPDLC application in a first one or more execution partitions, wherein the first one or more execution partitions are configured to implement a first CPDLC application and wherein messages from the first CPDLC application and a second CPDLC application in a second one or more execution partitions use the datalink router to interface with one or more radio transceivers. The method also includes when the second CPDLC application has an active current data authority (CDA) air traffic control (ATC) connection, inhibiting communication between the first CPDLC application and an ATC ground station by discarding downlink messages of the first CPDLC application from the datalink router.

20 Claims, 3 Drawing Sheets

(56) References Cited

U.S. PATENT DOCUMENTS

| | | | | |
|---|---|---|---|---|
| 8,244,452 | B2 * | 8/2012 | Judd et al. | 701/120 |
| 2007/0126621 | A1 * | 6/2007 | Sandell et al. | 342/36 |
| 2007/0129854 | A1 * | 6/2007 | Sandell et al. | 701/3 |
| 2008/0098307 | A1 | 4/2008 | Corbefin | |
| 2008/0163093 | A1 | 7/2008 | Lorido | |
| 2008/0208399 | A1 | 8/2008 | Pham | |
| 2009/0117895 | A1 * | 5/2009 | McGuffin | 455/431 |
| 2009/0258643 | A1 * | 10/2009 | McGuffin | 455/431 |
| 2010/0023247 | A1 | 1/2010 | Sandell et al. | |
| 2011/0133980 | A1 * | 6/2011 | Judd et al. | 342/37 |
| 2012/0078494 | A1 | 3/2012 | Judd et al. | |
| 2013/0090786 | A1 * | 4/2013 | Judd et al. | 701/3 |
| 2014/0372018 | A1 * | 12/2014 | Srinivasan et al. | 701/120 |

FOREIGN PATENT DOCUMENTS

| | | |
|---|---|---|
| EP | 2337000 | 6/2011 |
| EP | 2439899 | 4/2012 |
| WO | 2007064733 | 6/2007 |

OTHER PUBLICATIONS

U.S. Patent Office, "Final Office Action for U.S. Appl. No. 12/888,499", dated Mar. 4, 2015, pp. 1-19, Published in: US.
U.S. Patent Office, "Advisory Action", "from U.S. Appl. No. 12/888,499", dated May 13, 2015, pp. 1-7, Published in: US.
U.S. Patent and Trademark Office, "Office Action", "U.S. Appl. No. 12/888,499", dated Sep. 2, 2018, pp. 1-32, Published in: U.S.
European Patent Office, "Office Action", "from Foreign Counterpart of U.S. Appl. No. 12/633,918", dated Jan. 28, 2011, pp. 15, Published in: EP.
European Patent Office, "Extended European Search Report", "from Foreign Counterpart of U.S. Appl. No. 12/633,918", dated Mar. 11, 2011, pp. 17, Published in: EP.
U.S. Patent and Trademark Office, "Notice of Allowance", "U.S. Appl. No. 12/633,918", dated May 25, 2012, pp. 1-8.
U.S. Patent and Trademark Office, "Office Action", "U.S. Appl. No. 12/633,918", dated Jan. 11, 2012, pp. 122.
State Intellectual Property Office for People'S Republic of China, "Notification to Grant Patent Right for Invention for CN Application No. 201110340699.2", "Foreign Counterpart to U.S. Appl. No. 12/888,499", dated May 31, 2017, pp. 15, Published in: CN.
State Intellectual Property Office, P.R. China, "First Office Action from CN Application No. 201110340699.2 dated Sep. 2, 2015", "from Foreign Counterpart of U.S. Appl. No. 12/888,499", dated Sep. 2, 2015, pp. 1-13, Published in: CN.
State Intellectual Property Office, P.R. China, "Office Action from CN Application No. 201110340699.2 dated Mar. 25, 2016", "Foreign Counterpart to U.S. Appl. No. 12/888,499", dated Mar. 25, 2016, pp. 112, Published in: CN.
State Intellectual Property Office, P.R. China, "Office Action from CN Application No. 201110340699.2 dated Aug. 11, 2016", "from Foreign Counterpart of U.S. Appl. No. 12/888,499", dated Aug. 11, 2016, pp. 1-15, Published in: CN.
State Intellectual Property Office, P.R. China, "Office Action from CN Application 201110340699.2, dated Jan. 20, 2017", "from Foreign Counterpart of U.S. Appl. No. 12/888,499", dated Jan. 20, 2017, pp. 1-16, Published in: CN.
European Patent Office, "Office Action", "from Foreign Counterpart of U.S. Appl. No. 12/888,499", dated Apr. 16, 2012, pp. 1-3, Published in: EP.
European Patent Office, "European Search Report", "from Foreign Counterpart of U.S. Appl. No. 12/888,499", dated Mar. 22, 2012, pp. 1-3, Published in: EP.
U.S. Patent and Trademark Office, "Advisory Action", "from U.S. Appl. No. 12/888,499", dated Nov. 29, 2013, pp. 1-3, Published in: U.S.
U.S. Patent and Trademark Office, "Advisory Action", "U.S. Appl. No. 12/888,499", dated Sep. 8, 2014, pp. 1-3, Published in: U.S.
U.S. Patent and Trademark Office, "Decision on Appeal", "U.S. Appl. No. 12/888,499", dated Oct. 20, 2017, pp. 1-7, Published in: U.S.
U.S. Patent and Trademark Office, "Examiner's Answer", "U.S. Appl. No. 12/888,499", dated Oct. 22, 2015, pp. 1-8.
U.S. Patent and Trademark Office, "Final Office Action", "from U.S. Appl. No. 12/888,499", dated Sep. 23, 2013, pp. 1-21, Published in: U.S.
U.S. Patent and Trademark Office, "Final Office Action", "U.S. Appl. No. 12/888,499", dated Jun. 30, 2014, pp. 1-31, Published in: U.S.
U.S. Patent and Trademark Office, "Office Action", "U.S. Appl. No. 12/888,499", dated May 17, 2013, pp. 1-35.
U.S. Patent and Trademark Office, "Office Action", "from U.S. Appl. No. 12/888,499", dated Feb. 20, 2014, pp. 1-22, Published in: U.S.
State Intellectual Property Office of People's Republic of China, "Notification to Grant Patent Right for Invention for CN Application No. 201210415176.4", "Foreign Counterpart to U.S. Appl. No. 13/268,284", dated Dec. 20, 2016, pp. 1-5, Published in: CN.
State Intellectual Property Office, P.R. China, "First Office Action from CN Application No. 201210415176.4 dated Nov. 2, 2015", "from Foreign Counterpart od U.S. Appl. No. 13/268,284", dated Nov. 2, 2015, pp. 1-19, Published in: CN.
State Intellectual Property Office for People's Republic of China, "Second Office Action for CN Application No. 201210415176.4", "Foreign Counterpart to U.S. Appl. No. 13/268,284", dated Jul. 6, 2016, pp. 1-12, Published in: CN.
European Patent Office, "Office Action", "from Foreign Counterpart of U.S. Appl. No. 13/268,284", dated Mar. 15, 2013, pp. 1-5, Published in: EP.
European Patent Office, "European Search Report", "from Foreign Counterpart of U.S. Appl. No. 13/268,284", dated Mar. 4, 2013, pp. 1-4, Published in: EP.
European Patent Office, "Communication under Rule 71(3) for Application No. 12187027.3", "from U.S. Foreign Counterpart to U.S. Appl. No. 13/268,284", dated May 29, 2015, pp. 1-34, Published in: EP.
European Patent Office, "European Office Action for Application Serial No. 12187027.3", "from Foreign Counterpart to U.S. Appl. No. 13/268,284", dated Dec. 8, 2014, pp. 1-5, Published in: EP.
U.S. Patent and Trademark Office, "Advisory Action", "from U.S. Appl. No. 13/268,284", dated Jan. 16, 2014, pp. 1-3, Published in: U.S.
U.S. Patent and Trademark Office, "Advisory Action", "U.S. Appl. No. 13/268,284", dated Sep. 8, 2014, pp. 193, Published in: U.S.
U.S. Patent and Trademark, "Advisory Action", "from U.S. Appl. No. 13/268,284", dated Jul. 22, 2015, pp. 1-3, Published in: U.S.
U.S. Patent and Trademark Office, "Decision on Appeal", "From U.S. Appl. No. 13/268,284", dated Aug. 23, 2017, pp. 1-10, Published in: U.S.
U.S. Patent and Trademark Office, "Examiner's Answer", "From U.S. Appl. No. 13/268,284", dated Dec. 10, 2015, pp. 1-18, Published in: U.S.
U.S. Patent and Trademark Office, "Final Office Action", "from U.S. Appl. No. 13/268,284", dated Sep. 23, 2013, pp. 1-23, Published in: U.S.
U.S. Patent and Trademark Office, "Final Office Action", "from U.S. Appl. No. 13/268,284", dated Feb. 20, 2014, pp. 1-21, Published in: U.S.
The United States Patent Office, "Final Office Action", "U.S. Appl. No. 13/268,284", dated Jul. 1, 2014, pp. 1-23.
U.S. Patent Office, "Final Office Action", "from U.S. Appl. No. 13/268,284", dated Apr. 2, 2015, pp. 1-23, Published in: U.S.
U.S. Patent and Trademark Office, "Office Action", "U.S. Appl. No. 13/268,284", dated May 22, 2013, pp. 1-38.
U.S. Patent and Trademark Office, "Office Action", "from U.S. Appl. No. 13/268,284", dated Dec. 5, 2014, pp. 1-36, Published in: U.S.
U.S. Patent and Trademark Office, "Office Action", "U.S. Appl. No. 13/268,284", dated Dec. 14, 2017, pp. 1-33, Published in: U.S.
"PM-CPDLC Validation Report", Apr. 29, 2005, pp. 1-12, Publisher: Aeronautical Communications Panel—Working Group N.

(56) References Cited

OTHER PUBLICATIONS

Bousquie, Jean-Francois, "Data Link Communications: Operational & Human Factors Considerations", "Proceedings of Digital Avionics Systems Conference", Nov 1999, pp. 5.C.4-1 thru 5.C.4-8, Publisher: IEEE, Published in: St. Louis, MO.
Condis, "Standards for Seamless ATS Communications Transition Between Different Datalink Technologies", Mar. 19, 2010, pp. 1-7.
Sandell, "ATN Datalink on Boeing Airplanes", "Link 2000+ Incentives Workshop", Oct. 10-Nov. 2007, pp. 1-15, Publisher: The Boeing Company.
Sandell, "Datalink on the 787 Airplane", "ATN 2005", Sep. 20, 2005, pp. 1-42, Publisher: The Boeing company, Published in: London.
Judd et al., "Systems and Method for Managing Controller Pilot Data Link Communication (CPDLC) Systems", "U.S. Appl. No. 13/268,284, filed Oct. 7, 2011", pp. 1-26.
Judd et al, "Systems and Methods for Managing Non-Integrated Controller Pilot Data Link Communications (CPDLC) Systems on an Aircraft", "U.S. Appl. No. 12/888,499, filed Sep. 23, 2010"pp. 1-19.
U.S. Patent and Trademark Office, "Notice of Allowance for U.S. Appl. No. 13/268,284", dated Jul. 2, 2018, pp. 1-15, Published in: U.S.

* cited by examiner

SYSTEMS AND METHODS FOR MANAGING NON-INTEGRATED CPDLC SYSTEMS FROM A FIRST CPDLC SYSTEM

BACKGROUND

Two different systems for implementing Controller Pilot Data Link Communications (CPDLC) for air traffic control are available for commercial aircraft today. The first CPDLC system is referred to as the Future Air Navigation System (FANS), or FANS CPDLC. FANS based applications are typically implemented on an aircraft's Flight Management Computer (FMC), also referred to as the Flight Management System (FMS), and communicate with air traffic control (ATC) stations using text based messages communicated over the Aircraft Communications Addressing and Reporting System (ACARS). The second CPDLC system is implemented over the Aeronautical Telecommunication Network (ATN) via an aircraft's Communication Management Function (CMF) and is commonly referred to as ATN CPDLC. Use of FANS CPDLC versus ATN CPDLC on an aircraft is largely based on geographical considerations such that an aircraft that travels from and to a FANS CPDLC region to and from an ATN CPDLC region would greatly benefit from being able to support both CPDLC systems.

There are problems that arise however when both FANS CPDLC and ATN CPDLC systems are available to an aircraft's flight crew. First, creating a single integrated solution that manages and provides both CPDLC options has proven to be expensive to design and implement as compared to non-integrated solutions. Second, FANS and ATN CPDLC systems both require a logon (AFN logon or CM logon) and share "alerting" approaches when a CPDLC message is received from a ground controller. In cases where the CMF supports an ATN CPDLC application and an independent FMC supports a FANS CPDLC application, members of the flight crew may become confused as to which system to logon to and which system to access after getting a CPDLC alert. Also, with a non-integrated system, it is potentially possible to establish two different CPDLC current data authority (CDA) air traffic control (ATC) connections, one CDA ATC connection with each CPDLC application, at the same time. This presents a potentially dangerous situation because, by regulation, an aircraft is not permitted to have two CDA ATC connections concurrently, as that means two different air traffic controllers are in charge a single aircraft. Such a configuration may further face regulatory certification issues if not resolved and could also create training and flight work-load issues.

For the reasons stated above and for other reasons stated below which will become apparent to those skilled in the art upon reading and understanding the specification, there is a need in the art for improved systems and methods for managing non-integrated (CPDLC) systems on a single aircraft.

SUMMARY

The Embodiments of the present invention provide methods and systems for managing non-integrated (CPDLC) systems on a single aircraft and will be understood by reading and studying the following specification.

In one embodiment, a method for implementing a non-integrated CPDLC solution is provided. The method includes monitoring a datalink router for messages from a first CPDLC application in a first one or more execution partitions, wherein the first one or more execution partitions are configured to implement a first CPDLC application and wherein messages from the first CPDLC application and a second CPDLC application in a second one or more execution partitions use the datalink router to interface with one or more radio transceivers. The method also includes when the second CPDLC application has an active current data authority (CDA) air traffic control (ATC) connection, inhibiting communication between the first CPDLC application and an ATC ground station by discarding downlink messages of the first CPDLC application from the datalink router.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

Figure 1:
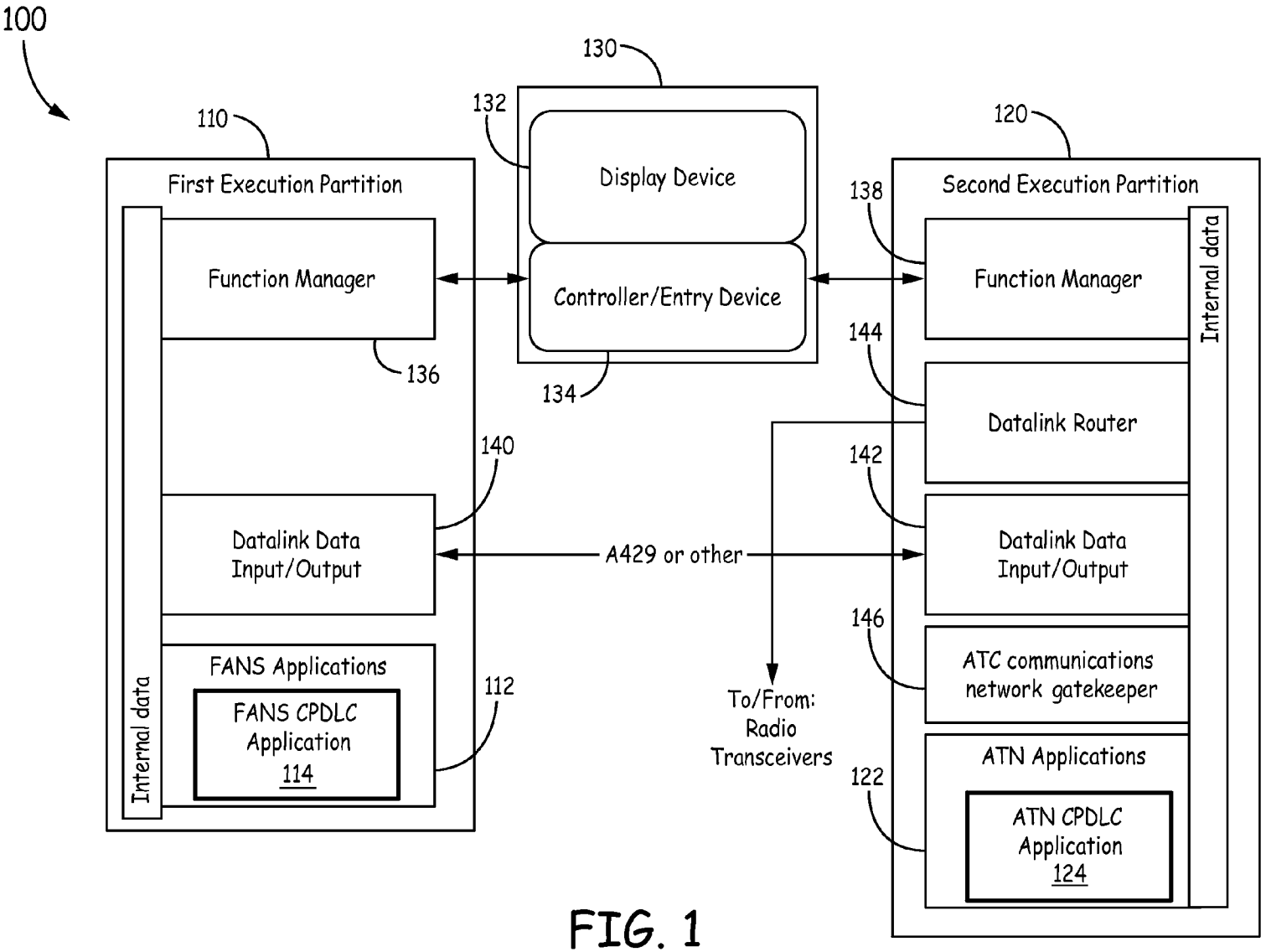
FIG. 1 is a block diagram of a system for implementing a non-integrated FANS/ATN CPDLC solution according to embodiments described herein.

FIG. 1 is a block diagram of an example system 100 for implementing a non-integrated FANS/ATN CPDLC solution on an aircraft. System 100 includes a first one or more execution partitions 110 for executing one or more FANS applications 112 including a FANS CPDLC application 114, and a second one or more execution partitions 120 for executing one or more ATN applications 122 including an ATN CPDLC application 124. The first one or more execution partitions 110 can be located in a flight management computer (FMC) or a flight management system (FMS) for the aircraft. The second one or more execution partitions 120 can be located in an ARINC 758 CMU/CMF or any datalink manager that can support ACARS and ATN communications for the aircraft. For simplicity FIG. 1 illustrates the FANS CPDLC on a single execution partition and the ATN CPDLC on a single execution partition; it should be understood, however, either or both the FANS and ATN CPDLC can be implemented on multiple respective execution partitions.

The first one or more execution partitions 110 are distinct from the second one or more execution partitions 120. That is, there are no common partitions between the first one or more execution partitions 110 and the second one or more execution partitions 120. Accordingly, the first one or more execution partitions 110 are implemented with software that is distinct from the software used to implement the second one or more execution partitions 120. The first one or more execution partitions 110 implementing FANS and the second one or more execution partitions 120 implementing ATN do not have access to each other's memory space and are executed independent of one another. The software implementing the first one or more and second one or more execution partitions 110, 120 can be stored or otherwise embodied on one or more storage mediums (such as flash or other non-volatile memory) including first instructions configured to implement the functions of the first one or more execution partitions 110 and second instructions configured to implement the functions of the second one or more execution partitions 120. The first and second instructions are configured to be executed on one or more processing devices. The one or more processing devices can include a general purpose processor or a special purpose processor. The first and second instructions are readable by the processing device(s) for execution thereby.

In a first example, the first and second instructions are executed on distinct hardware resources (e.g., on separate processing devices) and are stored on separate storage mediums (and are therefore in separate one or more partitions). In one implementation of such a first example, each execution partition 110, 120 can be implemented on a separate board/module within a common cabinet on an aircraft. In another implementation of such a first example, the first one or more execution partitions 110 can be implemented in a completely separate unit on the aircraft from the second one or more execution partitions 120. In a second example, the first and second instructions are executed on the same hardware resources (e.g., the same one or more processing devices), but the first and second instructions are in distinct sets of one or more partitions on the one or more storage mediums and operate independent threads on such hardware resources.

The subject matter described herein applies to non-integrated FANS and ATN CPDLC systems, and is not necessary in integrated FANS/ATN CPDLC systems in which the FANS and ATN CPDLC systems are implemented in one or more common partitions (i.e., implemented in the same partition). Such integrated FANS/ATN CPDLC systems do not present the same problems since, when the FANS and ATN CPDLC systems are operating in a common partition, the FANS and ATN CPDLC systems can easily determine what the other system is doing and can easily coordinate based thereon. Non-integrated FANS/ATN CPDLC systems do not have such a luxury, since the FANS and ATN CPDLC systems operate independently of one another. In some examples, the first and second one or more execution partitions 110, 120 have access to commonly used peripheral devices within the aircraft (e.g. audible alerting devices, human machine interfaces (HMIs), wireless communication radios, printers) and both send and receive data over a shared on-board data network. In other examples, the first and second one or more execution partitions 110, 120 can have access to distinct peripheral devices over distinct on-board data networks.

Figure 2:
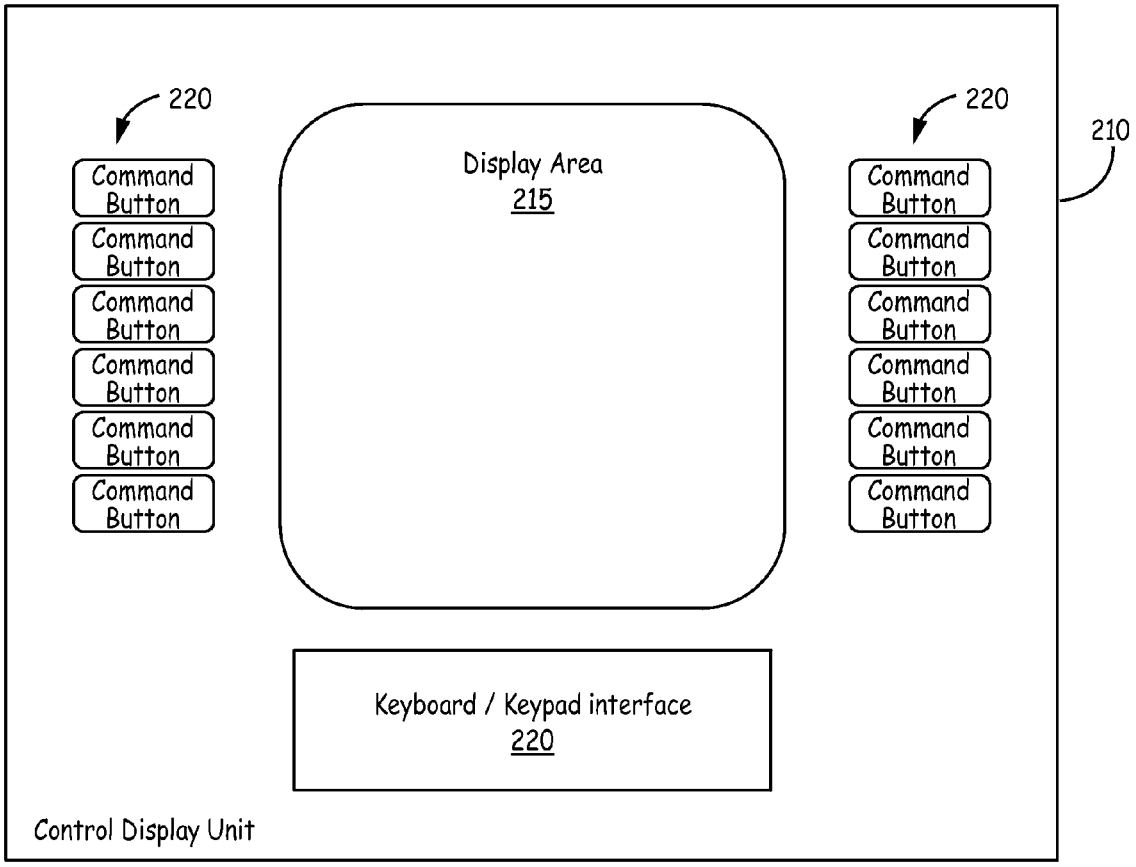
FIG. 2 is a block diagram of a control display unit (CDU) for a Human Machine interface according to embodiments described herein.

System 100 also includes one or more Human Machine Interfaces (HMIs) 130 in communication with the first one or more execution partitions 110 and the second one or more execution partitions 120. The one or more HMIs 130 provides at least display device 132 to present screens generated by the FANS and ATN CPDLC applications 114 and 124 to the flight crew for the aircraft. In one embodiment, one or more HMIs 130 include a Multifunction Display (MFD) which is a forward field graphical display device that graphically displays screens to the flight crew and provides a cursor controlled interface to flight crew users. In one embodiment shown in FIG. 2, the one or more HMIs 130 include a Control Display Unit (CDU) 210, such as a Multipurpose Control Display Unit (MCDU) having a display area 215, a plurality of programmable buttons 220 on either side of the display area 215, and a keyboard interface 220. In yet other embodiments, one or more HMIs 130 include those having a mixed implementation utilizing the resources of both a Multifunction Display (MFD) and a Control Display Unit (CDU) to interface with the flight crew.

In the embodiment of FIG. 1, HMIs 130 further comprises a controller/entry device 134 which drives one or more default screens which are displayed on HMIs 130 as needed to control the logon and access to the FANS and ATN CPDLC application's (114, 124) screens. The flight crew can select from those default screens which CPDLC/Logon system on the HMIs 130 that they wanted to use.

Each execution partition 110, 120, includes a function manager module 136, 138. Each of the function manager modules 136, 138 controls interaction between its associated CPDLC application (i.e., the FANS CPDLC application 114 and the ATN CPDLC application 124) and the HMI(s) 130.

System 100 also includes a datalink router 144. The datalink router 144 interfaces between the FANS CPDLC application 114 and the ATN CPDLC application 124 and the one or more radio transceivers by implementing the ACARS and ATN protocol stack for all datalinks for the aircraft. Thus, all datalink messages to and from the aircraft are processed through the ACARS and ATN protocol stacks implemented by the datalink router 144. Through the implementation of the ACARS and ATN protocol stacks, the datalink router 144 routes downlink messages to the appropriate radio transceiver for transmission therefrom. Similarly, the datalink router 144 routes uplink messages from each radio transceiver to their appropriate application (i.e., FANS CPDLC application 114 or ATN CPDLC application 124) for processing. Downlink FANS messages from the FANS CPDLC application 114 are sent to the datalink router 144 for routing to the appropriate radio transceiver. Uplink FANS messages are sent from a radio transceiver to the datalink router 144 for routing to the FANS CPDLC application 114. Messages to and from the ATN CPDLC application 124 are also routed by the datalink router 144. Accordingly, the ATN CPDLC application 124 sends downlink ATN messages to the datalink router 114 for routing to the appropriate radio transceiver and uplink ATN messages from a radio transceiver to the ATN CPDLC application 124.

The system 100 also includes an ATC communications network gatekeeper module 146. The gatekeeper module 146 ensures that the FANS CPDLC application 114 and the ATN CPDLC application 124 do not have active CDA ATC connections concurrently. A given CPDLC CDA ATC connection (FANS or ATN) can be in an active or inactive state. An active state includes both when the given CPDLC application is logged-on to an ATC ground station and when the given CPDLC application is attempting log-on to an ATC ground station. An inactive state includes all other situations. An attempting to log-on state occurs when a log-on request from a given CPDLC application has been transmitted by a radio transceiver to an ATC ground station, but a response from the ATC ground station confirming a log on has not yet been received. An attempting to log-on state is considered to be an active CDA ATC connection, since at least one message (the log-on request) between the CPDLC application and the ATC ground station is being sent, even though the CPDLC application is not currently logged-on.

The FANS CPDLC application 114 and the ATN CPDLC application 124 can independently establish their own CDA ATC connections with an ATC ground station. The FANS CPDLC application 114, however, does not have access to whether the ATN CPDLC 124 application has an active CDA ATC connection at a given time, and the ATN CPDLC application 124 does not have direct access to whether the FANS CPDLC application 114 has an active CDA ATC connection.

The gatekeeper module 146 can determine a status of the FANS CPDLC CDA ATC connection and the ATN CPDLC CDA ATC connection. The gatekeeper module 146 can then control the FANS CPDLC CDA ATC connection and the ATN CPDLC CDA ATC connection based on the status of the FANS CPDLC CDA ATC connection and the status of the ATN CPDLC CDA ATC connection.

To accomplish this, the gatekeeper module 146 monitors messages between the FANS CPDLC application 114 and the one or more radio transceivers. This monitoring can take any appropriate form, such as monitoring messages sent between the datalink I/O 142 and the datalink router 144, or more directly, by communicating with the datalink router 144 regarding messages to and from the FANS CPDLC application 114. In a particular example, all messages between the datalink router 144 and the one or more radio transceivers can pass through the gatekeeper module 146. In any case, the gatekeeper module 146 can monitor uplink and downlink messages to and from the FANS CPDLC application 114 to determine a status of the FANS CPDLC CDA ATC connection.

The gatekeeper module 146 can also monitor messages between the ATN CPDLC application 124 and the one or more radio transceivers. Similar to the monitoring of the messages for the FANS CPDLC application 114, monitoring of ATN CPDLC messages can be performed by monitoring messages sent between the ATN CPDLC application 124 and the datalink router 144, or more directly, by communicating with the datalink router 144 regarding messages to and from the ATN CPDLC application 124. In a particular example, all messages between the datalink router 144 and the one or more radio transceivers can pass through the gatekeeper module 146. In any case, the gatekeeper module 146 can monitor uplink and downlink messages to and from the ATN CPDLC application 124 to determine a status of the ATN CPDLC CDA ATC connection.

In some examples, the datalink router 144 and the gatekeeper module 146 reside in a third one or more execution partitions that are distinct from the first one or more and second one or more execution partitions. The third one or more execution partitions are distinct in the manner described above with respect to the first one or more and second one or more execution partitions.

In other examples, such as the example shown in FIG. 1, the datalink router 144 and the gatekeeper module 146 reside in the second one or more partitions 120 with the ATN CPDLC system. That is, the second one or more execution partitions 120 include the datalink router 144 and the gatekeeper module 146 such that their functions are performed by second instructions of the second one or more execution partitions 120. In such an example, the gatekeeper module 146 can have more direct coordination with the ATN CPDLC applications 124, and may not monitor the ATN CPDLC messages through the datalink router 144. Instead, the gatekeeper module 146 can coordinate directly with the ATN CPDLC application 124 to determine a status of the ATN CPDLC CDA ATC connection.

In such an example where the datalink router 144 resides in the second one or more partitions 120, messages between the datalink router 144 and the FANS CPDLC application 114, which resides in the first one or more execution partitions 110, are transferred between the sets of one or more execution partitions 110 and 120 using datalink data input/output (datalink I/O) modules 140, 142. The datalink I/O modules 140, 142 can communicate using a databus or shared memory. Example databuses include an ARINC 429 databus, back-plane bus, or Ethernet bus. The datalink I/O module 140 of the first one or more execution partitions 110 communicates with the FANS CPDLC application 114, and the datalink I/O module 142 of the second one or more execution partitions 120 communicates with the datalink router 144. Using the communication link between the datalink I/O modules 140, 142, the FANS CPDLC application 114 can send messages to the datalink router 144 and the datalink router 144 can send messages to the FANS CPDLC application 114.

In a first example, the gatekeeper module 146 can control the FANS CPDLC CDA ATC connection and the ATN CPDLC CDA ATC connection by preventing the FANS CPDLC application 114 and the ATN CPDLC application 124 from logging-on to any ATC ground station when the other CPDLC CDA ATC connection is active (i.e., in a logged-on or attempting to log-on state). In such a first example, if the ATN CPDLC CDA ATC connection is active, the gatekeeper module 146 can inhibit communication between the FANS CPDLC application 114 and any ATC ground station. This can prevent the FANS CPDLC application 114 from establishing an active CDA ATC connection while the ATN CPDLC CDA ATC connection is active. Likewise, the gatekeeper module 146 can also restrict the ATN CPDLC application 124 from establishing an active CDA ATC connection when the FANS CPDLC CDA ATC connection is active.

The gatekeeper module 146 can inhibit communication between the FANS CPDLC application 114 and any ATC ground station by discarding uplink and downlink FANS messages to and from the FANS CPDLC application 114. In implementations where all such FANS messages pass through the gatekeeper module 146 to and from the datalink router 144, the gatekeeper module 146 itself can discard the FANS messages by not forwarding the uplink FANS messages to the datalink router 144 and by not forwarding the downlink FANS messages to the appropriate radio transceiver. In other implementations, the gatekeeper module 146 can send a communication to the datalink router 144 causing the datalink router 144 to discard the uplink and downlink FANS messages. In any case, the gatekeeper module 146 can cause the FANS messages to be discarded such that FANS messages are not transferred between the FANS CPDLC application 114 and any ATC ground station. In some examples, the gatekeeper module 146 can generate and send one of an error message, abort message, or a disconnect message to be sent to the FANS CPDLC application 114 indicating that a log-on was not successful. Such an abort message or a disconnect message can be generated to emulate a message from a ground station, such that the abort message or disconnect message, when received by the FANS CPDLC application appear as though the message (abort or disconnect) was generated and sent from the ground station. When the ATN CPDLC CDA ATC connection is inactive (i.e., when the ATN CPDLC application 124 is not logged on), the gatekeeper module 146 can allow uplink and downlink FANS messages to and from the FANS CPDLC application 114.

Advantageously, in such a first example, the gatekeeper module 146 can function to prevent the FANS CPDLC application 114 from establishing an CDA ATC connection independent from and without any modification to legacy versions of the first one or more execution partitions 110 and the FANS applications 112. Accordingly, legacy FANS applications 112 and a legacy first one or more execution partitions 110 can be used. This is particularly advantageous in an avionics application as a new execution partition (for the first one or more execution partitions 110) does not need to be certified, and the solution is more easily retrofitted into existing systems.

As mentioned above, the ATN CPDLC application 124 is also restricted from establishing an active CDA ATC connection when the FANS CPDLC CDA ATC connection is active (i.e., in a logged-on or attempting to log-on state). In one implementation, the gatekeeper module 146 can inhibit communication between the ATN CPDLC application 124 and any ATC ground station when the FANS CPDLC CDA ATC connection is active by causing uplink and downlink ATN messages to be discarded in the same manner as described with respect to the uplink and downlink FANS messages. In another implementation, the gatekeeper module 146 can notify the function manager module 138 when the FANS CPDLC CDA ATC connection is active and the function manager module 138 can restrict access by the flight crew to the ATN CPDLC application 124. For example, the function manager module 138 can prevent access to screens of the ATN CPDLC application 124 by the flight crew or otherwise prevent the flight crew from logging-on or sending the log on request. When the FANS CPDLC CDA ATC connection is inactive, the gatekeeper module 146 can allow uplink and downlink ATN messages to and from the ATN CPDLC application 124 and the function manager module 138 can allow unrestricted access by the flight crew to the ATN CPDLC application 124.

As mentioned above, the gatekeeper module 146 can determine the status of the FANS CPDLC CDA ATC connection based on monitoring of FANS messages to and from the FANS CPDLC application 114. The status determined can be used as described above to restrict or not restrict the ATN CPDLC application 124 from establishing an active CDA ATC connection. Moreover, the gatekeeper module 146 can also determine the status of the ATN CPDLC CDA ATC connection in order to inhibit or not inhibit message transfer between the FANS CPDLC application 114 and a ground station. In one implementation, the gatekeeper module 146 determines the status of the ATN CPDLC CDA ATC connection by monitoring messages to and from the ATN CPDLC application as they pass through itself or through the datalink router 144. In another implementation, the gatekeeper module 146 communicates with the ATN CPDLC application 124 or the function manager 138 to determine the status of the ATN CPDLC CDA ATC connection.

In one implementation of the first example, the gatekeeper module 146 can perform the above actions automatically, that is, without additional input from the flight crew. In another implementation, the gatekeeper module 146 can notify the function manager module 138 of some or all such instances when the FANS CPDLC application 114 and the ATN CPDLC application 124 are attempting to log-on when the other CPDLC CDA ATC connection is active. The function manager module 138 can then send an alert to the HMI(s) 130 to display to the fight crew.

For example, when the ATN CPDLC CDA ATC connection is active and the gatekeeper module 146 identifies a FANS log-on request from the FANS CPDLC application 114, the gatekeeper module 146, instead of automatically discarding the request, can notify the function manager module 138 of the request, and the function manager module 138 can send an alert to the HMI(s) 130 to display to the fight crew. The alert can notify the flight crew than the FANS CPDLC application 114 is requesting to log on, and ask if the flight crew would like to log off the current ATN CPDLC CDA ATC connection or cancel/abort the ATN CPDLC CDA ATC connection request. If the flight crew selects that they do not want to log off the current ATN CPDLC CDA ATC connection/cancel the ATN CPDLC CDA ATC connection request, the function manager 138 can notify the gatekeeper module 146 and the gatekeeper module 146 can discard the FANS log-on request. If the flight crew selects that they do want to log off/cancel the ATN CPDLC CDA ATC connection request, the function manager 138 can notify the gatekeeper module 146 and the ATN CPDLC application 124. The ATN CPDLC application 124 can then log off/cancel the request, and the gatekeeper module 146 can allow the FANS log-on request from the FANS CPDLC application 114 to be transmitted to a ground station.

In some implementations, the gatekeeper module 146 can similarly notify the function manager module 138 when an uplink FANS message is received while the ATN CPDLC CDA ATC connection is active. In such implementations, a similar alert can be provided to the flight crew and the flight crew can select whether to log off/abort the current ATN CDA ATC connection, cancel/abort a log on request for the ATN CDA ATC connection, or ignore the uplink FANS message.

In a second example of controlling the CDA ATC connection, the gatekeeper module 146 can control the FANS CPDLC CDA ATC connection and the ATN CPDLC CDA ATC connection by providing either the FANS CPDLC application 114 or the ATN CPDLC application 124 with priority over the other application 124, 114 regardless of the status of the other CPDLC CDA ATC connection.

In a first implementation of such an example, the gatekeeper module 146 can provide priority to the ATN CPDLC application 124. In such an implementation, the gatekeeper module 146 can prevent the FANS CPDLC application 114 from logging-on when the ATN CPDLC has an active CDA ATC connection. Additionally, when the FANS CPDLC has an active CDA ATC connection and a log-on request is received from the ATN CPDLC application 124, the gatekeeper module 146 can inhibit further communication on the FANS CPDLC CDA ATC connection. The gatekeeper module 146 can prevent the FANS CPDLC application 114 from logging-on by discarding uplink and downlink FANS messages in the manner discussed with respect to the first example of controlling access. Similarly, the gatekeeper module 146 can inhibit further communication on an active FANS CPDLC CDA ATC connection by also discarding uplink and downlink FANS messages in the same manner. The gatekeeper module 146 may also send a fabricated uplink message to the FANS CPDLC application instructing the FANS CPDLC application to log-off or abort the FANS CPDLC CDA ATC connection. Such a fabricated uplink message can be generated by the gatekeeper module 146, but appear to the FANS CPDLC application as though it has been generated by the ATC ground station. Such operations of preventing the FANS CPDLC application 114 from logging-on and inhibiting further communication on the FANS CPDLC CDA ATC connection can be performed automatically (without additional input from the flight crew), or can be performed on demand by providing notifications to the flight crew in a similar manner to that described with respect to the first example of controlling access.

In a second implementation of such a second example, the gatekeeper module 146 can provide priority to the FANS CPDLC application 114. In such an implementation, the gatekeeper module 146 can prevent the ATN CPDLC application 124 from logging-on when the FANS CPDLC CDA ATC connection is active; and when the ATN CPDLC CDA ATC connection is active and a log-on request is received from the FANS CPDLC application 114, the gatekeeper module 146 can cause a disconnection of the ATN CPDLC CDA ATC connection. The gatekeeper module 146 prevent the ATN CPDLC application from logging-on by inhibiting communication between the ATN CPDLC application 124 and a ground station by causing uplink and downlink ATN messages to be discarded in the same manner as described with respect to the uplink and downlink FANS messages in the first example of controlling access. Instead of, or in addition to discarding ATN messages, the gatekeeper module 146 notify the function manager module 138 when the FANS CPDLC CDA ATC connection is active and the function manager module 138 can restrict access by the flight crew to the ATN CPDLC application 124 or can have the ATN CPDLC application disconnected/aborted. Similarly, gatekeeper module 146 can cause a disconnection of the ATN CPDLC CDA ATC connection by discarding uplink and downlink ATN messages or by notifying the function manager module 138 when a FANS log-on request is being sent and cause a log-off/abort/disconnect request to be sent by the ATN application 124. The gatekeeper module 146 may also send a fabricated uplink message to the ATN CPDLC application instructing the ATN CPDLC application to log-off or abort the ATN CPDLC CDA ATC connection. Such a fabricated uplink message can be generated by the gatekeeper module 146, but appear to the ATN CPDLC application as though it has been generated by the ATC ground station. Such operations of preventing the ATN CPDLC application 124 from logging-on and causing the ATN CPDLC CDA ATC connection to be disconnected can be performed automatically (without additional input from the flight crew), or can be performed on demand by providing notifications to the flight crew in a similar manner to that described with respect to the first example of controlling access.

In a third example, the gatekeeper module 146 can provide priority to a newly requested connection over an existing connection, regardless of which connection is the newly requested and the existing. In such an example, the gatekeeper module 146 can cause a disconnection of the existing connection and allow the log-on request from the new connection to be sent to a ground station. For example, if the ATN CPDLC CDA ATC connection is active and a log-on request is initiated by the FANS CPDLC application, the gatekeeper module 146 can cause a disconnection of the ATN CPDLC CDA ATC connection and allow the log-on request from the FANS CPDLC application to be sent to a ground station. The gatekeeper module 146 can cause a disconnection of the ATN CPDLC CDA ATC connection in the same manner described above with respect to the second example. Likewise, if the FANS CPDLC CDA ATC connection is active and a log-on request is initiated by the ATN CPDLC application, the gatekeeper module 146 can inhibit further communication on the FANS CPDLC CDA ATC connection. The gatekeeper module 146 can inhibit further communication on the FANS CPDLC CDA ATC connection in the same manner described above with respect to the second example. In this way, the gatekeeper module 146 can always allow the newly requested connection to be established, thereby providing priority to a pilot's most recent request.

In a fourth example, the gatekeeper module 146 can provide priority to an existing connection over a newly requested connection, regardless of which connection is the existing connection and the newly requested connection. In such an example, the gatekeeper module 146 can prevent the newly requested connection from logging-in and allow the exiting connection to continue communicating with the ground station.

Figure 3:
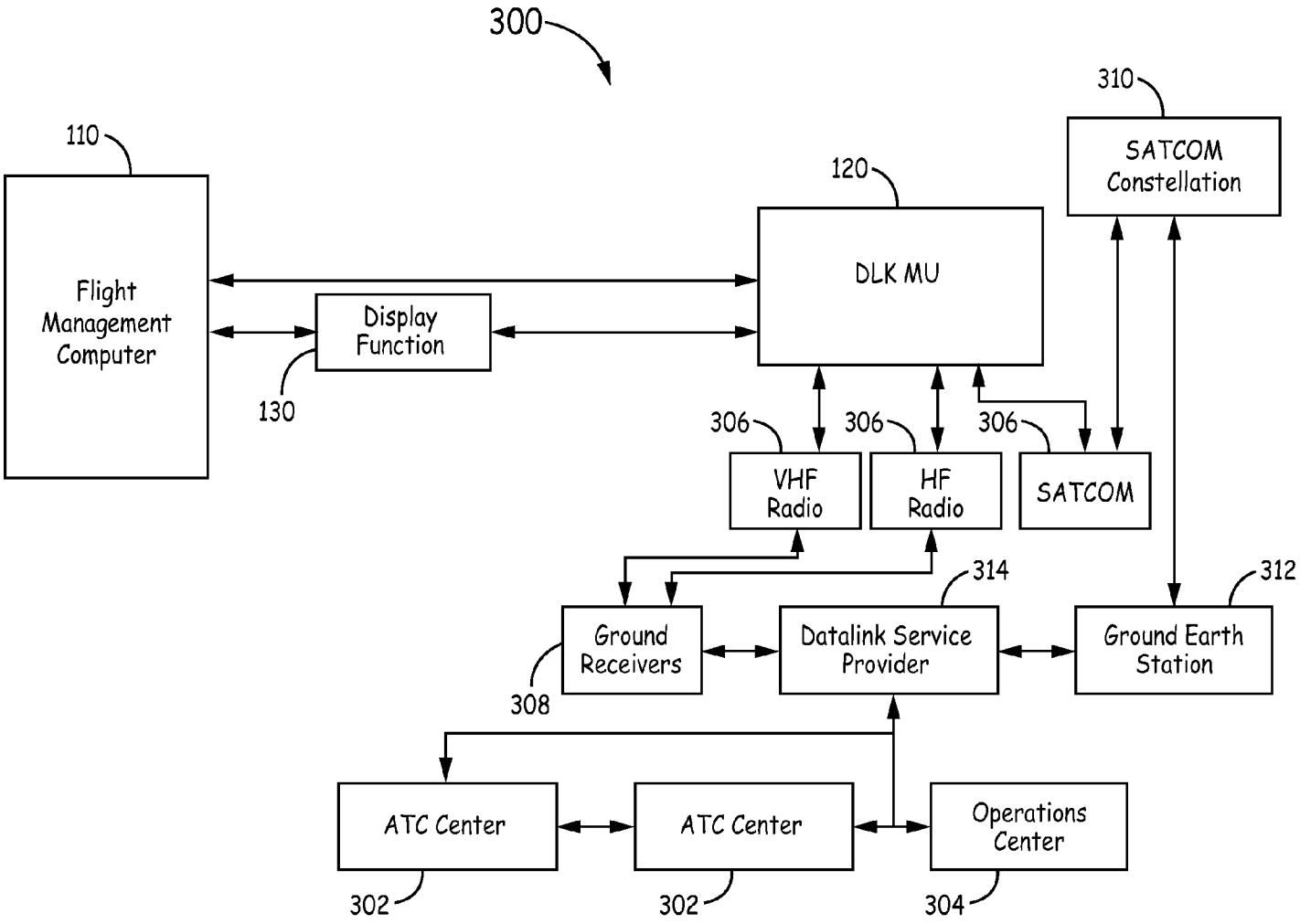
FIG. 3 is another block diagram of a system for implementing a non-integrated FANS/ATN CPDLC solution according to embodiments described herein.

FIG. 3 is a block diagram of an example of the avionics system 100 showing additional components. FIG. 3 illustrates the first one or more execution partitions 110 and the second one or more execution partitions 120 each in communication with the HMIs 130. In this example, the first one or more execution partitions 110 is implemented in a flight management computer (FMC), although in other embodiments, the first one or more execution partitions 110 can be implemented in an FMS. The second one or more execution partitions 120 are implemented in a datalink manager unit (DLK MU). The DLK MU can include an ARINC 758 CMU/CMF or any datalink manager that can support ACARS and ATN communications. The first one or more execution partitions 110 and the second one or more execution partitions 120, which are disposed on an aircraft, communicate bi-directionally with a ground station such as an ATC center 302 and/or an operations center 304 on the ground. As shown, communications between the first one or more execution partitions 110 and such ATC center 302 and/or operations center 304 occur through the second one or more execution partitions 120. That is, all messages between the first one or more execution partitions 110 and an ATC center 302 and/or operations center 304 are routed through the second one or more execution partitions 120, in particular, through the datalink router 144 in the second one or more execution partitions 120. Messages from the first one or more execution partitions 110 and the second one or more execution partitions 120 are sent from the second one or more execution partitions 120 to the appropriate radio transceiver 306. In this example, the radio transceivers 306 include a very high frequency (VHF) radio, high frequency (HF) radio, and a satellite radio. In other examples, other radios can be used. The VHF and HF radios transmit and receive radio signals with ground receivers 308. The satellite radio communicates through a satellite constellation 310 to a ground earth station 312. The ground earth station 312 and the ground receivers 308 communicate with the ATC center(s) 302 and/or the operations center 304 via a datalink service provider 314. Using this communication system messages can be transmitted between the first and second execution partitions 110, 120 on the aircraft and the appropriate entities on the ground. Messages may also be sent from the second one or more execution partitions 120 to a cockpit voice recorder 316. The first one or more execution partitions 110 and the second one or more execution partitions 120 can also communicate with a crew alerting function 318 and a printer 320.

Although the examples discussed above utilize FANS and ATN CPDLC applications running over ACARS and ATN networks, the subject matter described herein is not limited to just these two CPDLC systems and network options. That is, the subject matter described herein can be implemented in, and includes systems where the first and/or second execution partition 110, 120 are configured to implement CPDLC systems other than FANS and ATN, including future CPDLC systems, such as new versions of the ATN CPDLC system. In such examples, the subject matter described herein can be used to control access by the first and/or second execution partition to their respective datalinks in any of the manners described above.

What is claimed is:

1. A system for implementing a non-integrated controller pilot data link communications (CPDLC) solution, the system comprising:

a first one or more execution partitions executing one or more first applications including a first CPDLC application;

a second one or more execution partitions executing one or more second applications including a second CPDLC application;

a datalink router for interfacing between the first and second CPDLC applications and one or more radio transceivers; and a gatekeeper module that monitors messages in the datalink router corresponding to the first CPDLC application and inhibits communication between the first CPDLC application and any air traffic control (ATC) ground station when the second CPDLC application has an active current data authority (CDA) ATC connection.

2. The system of claim 1, wherein the gatekeeper module inhibits communication by causing the datalink router to discard downlink messages from the first CPDLC application such that the downlink messages are not transmitted to any ATC ground station, and to discard uplink messages to the first CPDLC application such that the uplink message are not routed to the first CPDLC application.

3. The system of claim 2, wherein the gatekeeper module upon discarding a downlink message, is configured to generate and send one of an error message, abort message, or a disconnect message to the first CPDLC application, wherein the abort message and the disconnect message can be generated to emulate a message from an ATC ground station.

4. The system of claim 1, wherein the datalink router and the gatekeeper module reside in the second one or more execution partitions, wherein the gatekeeper module coordinates with the second CPDLC application to determine whether the second CPDLC application has an active CDA ATC connection.

5. The system of claim 1, wherein the gatekeeper module resides a third one or more execution partitions, the gatekeeper module is configured to determine when the second CPDLC application has an active CDA ATC connection based on messages in the datalink router.

6. The system of claim 1, wherein the second CPDLC application has an active CDA ATC connection when the second CPDLC application is logged-on or attempting to log-on to an ATC ground station.

7. The system of claim 1, wherein the gatekeeper module is configured to allow messages from the first CPDLC application to pass through the datalink router and be transmitted by one of the one or more radio transceivers when the second CPDLC application does not have an active CDA ATC connection.

8. The system of claim 1, wherein the gatekeeper module is configured to prevent the first CPDLC application and the second CPDLC application from logging-on to any ATC ground station when the other CPDLC CDA ATC connection is active.

9. The system of claim 1, wherein the gatekeeper module is configured to give priority to the second CPDLC application such that when the first CPDLC application has an active CDA ATC connection, the gatekeeper module inhibits further communication between the first CPDLC application and any air traffic control (ATC) ground station when the second CPDLC application sends a log-on request.

10. The system of claim 1, wherein the gatekeeper module is configured to give priority to a newly requested connection over an existing connection, regardless of whether the first CPDLC application or the second CPDLC application is the newly requested connection or the existing connection.

11. The system of claim 1, wherein the gatekeeper module is configured to give priority to an existing connection over a newly requested connection, regardless of whether the first CPDLC application or the second CPDLC application is the existing connection or the newly requested connection.

12. The system of claim 1, wherein the one or more first CPDLC applications are one or more ATN CPDLC applications and the one or more second CPDLC application are one or more FANS CPDLC applications.

13. A method for implementing a non-integrated controller pilot data link communications (CPDLC) solution, the method comprising:

monitoring a datalink router for messages from a first CPDLC application in a first one or more execution partitions, wherein the first one or more execution partitions are configured to implement a first CPDLC application and wherein messages from the first CPDLC application and a second CPDLC application in a second one or more execution partitions use the datalink router to interface with one or more radio transceivers; and when the second CPDLC application has an active current data authority (CDA) air traffic control (ATC) connection, inhibiting communication between the first CPDLC application and an ATC ground station by discarding downlink messages of the first CPDLC application from the datalink router.

14. The method of claim 13, wherein when the first CPDLC application has an active CDA ATC connection, restricting the second CPDLC application from establishing an active CDA ATC connection.

15. The method of claim 14, comprising:

determining when the first CPDLC application has an active CDA ATC connection based on messages in the datalink router.

16. The method of claim 14, wherein when the first CPDLC application has an active CDA ATC connection includes when the first CPDLC application is attempting to log-on and when the first CPDLC application is logged-on to an ATC ground station; and when the second CPDLC application has an active CDA ATC connection includes when the second CPDLC application is attempting to log on and when the second CPDLC application is logged-on to an ATC ground station.

17. The method of claim 13, comprising:

providing priority to the second CPDLC application such that when the first CPDLC application has an active CDA ATC connection, the gatekeeper module inhibits further communication between the first CPDLC application and any air traffic control (ATC) ground station when the second CPDLC application sends a log-on request.

18. The method of claim 13, wherein the first CPDLC application is a FANS CPDLC application and the second CPDLC application is an ATN CPDLC application.

19. A system for implementing a non-integrated FANS/ATN controller pilot data link communications (CPDLC) solution, the system comprising:

a first one or more execution partitions executing an ATN CPDLC application;

a second one or more execution partitions in communication with the first one or more execution partitions, the second one or more execution partitions executing a FANS CPDLC application, wherein the first one or more execution partitions are configured to implement a datalink router for interfacing between the ATN and FANS CPDLC applications and one or more radio transceivers;

one or more Human Machine Interfaces (HMIs) in communication with the first execution partition and the second execution partition, the one or more HMIs configured to display screens generated by the ATN CPDLC application and configured to display screens generated by the FANS CPDLC application; and wherein the first one or more execution partitions includes a gatekeeper module that monitors messages in the datalink router corresponding to the FANS CPDLC application and causes downlink and uplink messages corresponding to the FANS CPDLC application to be discarded when the ATN CPDLC application is logged on, or attempting to establish, a current data authority (CDA) air traffic control (ATC) connection, and wherein the gatekeeper module is configured to allow uplink and downlink messages corresponding to the FANS CPDLC application to pass through the datalink router when the ATN CPDLC application is not logged-on to, or attempting to establish, a CDA ATN connection.

20. The system of claim 19, wherein the first one or more execution partitions includes a function manager module configured to restrict access to the ATN CPDLC application when the FANS CPDLC application is logged on to, or attempting to establish, a CDA ATC connection.

* * * * *